US010823436B2

(12) United States Patent
Mongar

(10) Patent No.: US 10,823,436 B2
(45) Date of Patent: Nov. 3, 2020

(54) AIR CONDITIONING METHOD USING A STAGED PROCESS USING A LIQUID DESICCANT

(71) Applicant: AirGreen, Inc., New Castle, DE (US)

(72) Inventor: Andrew Mongar, West Chester, PA (US)

(73) Assignee: AirGreen, Inc., New Castle, DE (US)

( * ) Notice: Subject to any disclaimer, the term of this patent is extended or adjusted under 35 U.S.C. 154(b) by 0 days.

(21) Appl. No.: 15/962,462

(22) Filed: Apr. 25, 2018

(65) Prior Publication Data

US 2018/0238568 A1 Aug. 23, 2018

Related U.S. Application Data

(62) Division of application No. 14/681,448, filed on Apr. 8, 2015, now Pat. No. 9,982,901.

(60) Provisional application No. 61/979,882, filed on Apr. 15, 2014.

(51) Int. Cl.
*F24F 3/14* (2006.01)

(52) U.S. Cl.
CPC .... *F24F 3/1417* (2013.01); *F24F 2003/1458* (2013.01)

(58) Field of Classification Search
CPC ..... F24F 3/1417; F24F 3/1411; F24F 2003/1458; F24F 5/0014; B01D 53/263; B01D 53/14; B01D 53/1406; B01D 53/1412; F25B 17/02
USPC ..... 62/94, 271, 238.3, 175, 335
See application file for complete search history.

(56) References Cited

U.S. PATENT DOCUMENTS

| | | | |
|---|---|---|---|
| 4,164,125 | A | 8/1979 | Griffiths |
| 4,391,321 | A | 7/1983 | Thunberg |
| 4,979,965 | A | 12/1990 | Sannholm |
| 4,982,782 | A | 1/1991 | Albers et al. |
| 5,020,335 | A | 6/1991 | Albers et al. |
| 5,020,588 | A | 6/1991 | Albers et al. |

(Continued)

FOREIGN PATENT DOCUMENTS

| | | | |
|---|---|---|---|
| CN | 1506630 | A | 6/2004 |
| CN | 203132011 | U | 8/2013 |

(Continued)

OTHER PUBLICATIONS

Andrusiak et al., "Modeling of a Solar Thermally-Driven Liquid-Desiccant Air Conditioning System", American Solar Energy Society 2010, pp. 7.

(Continued)

*Primary Examiner* — Joseph F Trpisovsky
(74) *Attorney, Agent, or Firm* — Perkins Coie LLP

(57) ABSTRACT

In a process and apparatus of conditioning an airstream, the airstream is contacted with a liquid desiccant absorber in each of at least two stages. The same apparatus used as an evaporator to reconcentrate the desiccant. The desiccant for each said stage is cooled or heated externally to the absorber or evaporator using an external source of cooling supplied with a common cooling or heating fluid at each stage. The desiccant flows between the stages counter-current to the flow of the airstream such that at each step the concentration of the desiccant is reduced or increased by contact with the airstream so that the concentration in each stage is distinct from the concentration of the desiccant in the previous stages.

16 Claims, 5 Drawing Sheets

(56) References Cited

U.S. PATENT DOCUMENTS

| | | | | |
|---|---|---|---|---|
| 5,123,481 | A | 6/1992 | Albers et al. | |
| 5,146,978 | A | 9/1992 | Albers et al. | |
| 5,351,497 | A | 10/1994 | Lowenstein | |
| 5,426,953 | A | 6/1995 | Meckler | |
| 5,460,004 | A | 10/1995 | Tsimerman | |
| 6,138,470 | A | 10/2000 | Potnis et al. | |
| 6,216,489 | B1 | 4/2001 | Potnis et al. | |
| 6,513,339 | B1 | 2/2003 | Kopko | |
| 6,854,279 | B1 | 2/2005 | Digiovanni et al. | |
| 7,942,387 | B2 | 5/2011 | Forkosh | |
| 8,196,907 | B2 | 6/2012 | Zhang et al. | |
| 8,268,060 | B2 | 9/2012 | Hargis et al. | |
| 2004/0211207 | A1 | 10/2004 | Forkosh et al. | |
| 2004/0261440 | A1 | 12/2004 | Forkosh et al. | |
| 2005/0109052 | A1* | 5/2005 | Albers | F24F 3/1417 62/271 |
| 2010/0000247 | A1 | 1/2010 | Bhatti et al. | |
| 2010/0175394 | A1* | 7/2010 | Albers | F24F 3/1417 62/94 |
| 2011/0132027 | A1 | 6/2011 | Gommed et al. | |
| 2011/0138832 | A1 | 6/2011 | Al-Hadhrami et al. | |
| 2012/0186281 | A1* | 7/2012 | Vandermeulen | B01D 53/263 62/92 |
| 2013/0186121 | A1 | 7/2013 | Erb et al. | |
| 2013/0227982 | A1 | 9/2013 | Forkosh | |
| 2013/0255287 | A1 | 10/2013 | Forkosh | |
| 2013/0305752 | A1 | 11/2013 | Martin | |
| 2013/0318790 | A1 | 12/2013 | Becze et al. | |
| 2013/0340449 | A1 | 12/2013 | Kozubal et al. | |

FOREIGN PATENT DOCUMENTS

| | | | |
|---|---|---|---|
| WO | 2004081462 | A1 | 9/2004 |
| WO | 2004111557 | A1 | 12/2004 |
| WO | 2013032969 | A1 | 3/2013 |
| WO | 2013172789 | A1 | 11/2013 |

OTHER PUBLICATIONS

ISA, International Search Report, dated Jul. 20, 2015, 2 pages.
ISA, Written Opinion of International Search Report, dated Jul. 20, 2015, 4 pages.
Mohammad et al., "Artificial Neural Network Analysis of Liquid Desiccant Dehumidifier Performance in a Solar Hybrid Air Conditioning System", Applied Thermal Engineering, 59. 1-2, Sep. 25, 2013, pp. 389-397, published in UK.
Japanese Office Action dated Nov. 5, 2019 for Japanese Patent Application No. 2017-506252, 3 pgs.
Indian First Examination Report dated Nov. 7, 2019 for Indian Patent Application No. 201617038323, 8 pgs.
Chinese Office action dated Sep. 20, 2019 for Chinese Patent Application No. 201580025807.3, 7 pages.
European Exam Report dated Oct. 9, 2019 for European Patent Application No. 15779439.7, 4 pages.

* cited by examiner

AIR CONDITIONING METHOD USING A STAGED PROCESS USING A LIQUID DESICCANT

FIELD OF THE INVENTION

The invention relates to air conditioning, humidification, and dehumidification.

BACKGROUND

A major deficiency of most existing air conditioning systems is their inability to remove high levels of humidity such as those associated with the significant quantities of outside air that are requited by the American Society of Heating, Refrigerating, and Air-Conditioning Engineers (ASHRAE) standards (mandatory in the U.S.) and for health reasons. A number of desiccant systems have been tried in order to solve this problem economically but none has achieved high market penetration.

The energy used in buildings for hearing and cooling comprises more than 30% of all energy used in the USA. Much of this energy is from fossil fuel sources, and the level of usage of fossil fuels is currently causing much concern. In particular, air conditioning is almost entirely powered by electricity, most of which is from fossil fuels. Electricity used for air conditioning also contributes to a large peak of electrical consumption that requires a high level of expensive peak power generation plant capacity. It would therefore be desirable if air conditioning were much more efficient in its use of electric power or were powered by non-electric or non-fossil fuel sources.

Air conditioning by compressors can remove only a fraction of the humidity from the air in humid climates. This leads to a provision of excess capacity and low refrigeration temperatures for humidity removal and the need to re-heat the air supplied to buildings. Both of these factors require considerable power usage and energy wastage. U.S. Department of Energy sources indicate that this could be as high as 60% of energy used in air conditioning. A large quantity (about 31% globally) of primary energy supplied results in waste heat that could be collected and used for low temperature energy use such as the air conditioner described below.

Desiccant-based dehumidifiers and air conditioners have been introduced to the market on a number of occasions over the past 75 years but they have not been well received for a number of reasons. Firstly, they have been expensive to buy and energy savings from their use have not been sufficient to pay back the capital cost on a time-scale considered economic to most building owners and operators. Secondly, some liquids desiccant systems were prone to allow droplets of the liquid desiccant to carry over into the conditioned space, which is highly undesirable.

U.S. Pat. No. 5,123,481 to Albers et al. describes a process of air-cooling and dehumidification. In U.S. Pat. No. 5,123,481 Albert et al. use sectors in an air stream and partitions or heat exchangers to transfer the heat to an airstream in a second chamber in which water is evaporated as a heat sink.

U.S. Pat. Nos. 4,982,782, 5,020,335 and 5,020,588, also to Albers et al., use a heat connecting partition and a plurality of gas streams.

Lowenstein U.S. Pat. No. 5,351,497 uses a low flow desiccant system that does not use turbulent heat exchange nor multiple sectors.

Hargis U.S. Pat. No. 8,268,060 B2 discloses a device using liquid desiccant and a compressor and heat exchangers. Hargis splits the desiccant streams into two components only one of which is passed through a heat exchange. Thus Hargis is exposing the air streams to two (or more) desiccant stages that are at different temperatures rather than different relative humidities. Hargis also regenerates the desiccant using an outside airstream rather than the drier exhaust air from the building.

Forkosh has U.S. Pat. Nos. 6,487,872, 6,494,053, 6,575,228, and 6,976,365 that use a liquid desiccant and usually a compressor to provide the heat sink and source. Forkosh uses a single sump in either she dehumidifier or regenerator and the desiccant therefore mixes to a single concentration. Thus the "stages" described by Forkosh do not enable the separation of the desiccant into differing concentrations.

Albers and Yuan filed application US 2005/0109052 A1 for a device using a compressor and liquid desiccant. Although that device had distinct sectors, it was not arranged for separate heat input and output in each of these sectors. The heat transfer from the heat source (compressor) to the heat and mass transfer substance (desiccant) takes place at only one of the sectors, and the objective of the method is stated to be to induce a "temperature gradient" in the desiccant between the sectors rather than a concentration gradient.

There is a need for a dehumidification and/or air conditioning device that enables the use of lower temperature regeneration heat sources and less-cold cooling sources.

SUMMARY

In an embodiment of the air conditioner, an air stream, which may be 100% outside air, is humidity controlled by contact with a liquid desiccant of progressively changing concentration in a number of sectors. If the air is more humid than desired, it is dehumidified by contact with concentrated liquid desiccant distributed on a medium with a large wetted surface area in a number of sectors. If the air is less humid than desired (in winter mode) water is added to the desiccant in the air conditioner. The concentration of the desiccant supplied to the device determines the humidity content of the air supplied to the conditioned space. Passing a cooling fluid through heat exchangers cools the air by contact with the cooled desiccant. Thus, in all seasons the air humidity and temperature may be controlled by supplying the air conditioner with a suitable heating and cooling fluid and a suitable desiccant concentration.

The cooling fluids are supplied in parallel to each heat exchanger in each sector of the air conditioner and at essentially the same temperature to maximize the heat transfer out of the desiccant and thus from the treated air. This maximizes the enthalpy change in each sector and enables a lower source temperature to be used than if the cooling fluid is supplied in series to each heat exchanger. As will be evident and can be seen on the psychometric chart in FIG. 1, the enthalpy required in each sector may differ because of differing loads due to unequal latent heat loads. A higher load increases the temperature of the desiccant in that sector, and therefore increases the heat transfer rate into the cooling fluid in that sector through the heat exchanger. A similar argument applies to the effectiveness of using a common heating source for each sector in the desiccant regenerator.

A contributing feature to the effectiveness of certain of the described apparatus and methods is separation of the desiccant by concentration into multiple sectors in which the air is first treated by the most dilute desiccant. This causes a temperature rise in that sector. The amount of dehumidification of the air in that sector is limited by the concentration of the desiccant and by the amount of heat that can be removed by the cooling fluid, as can be seen on the psychrometric chart, FIG. 1. The air moves to the next sector where the desiccant is more concentrated and the air is further dried as far as the desiccant concentration and heat removal allows. Multiple sectors are required to achieve a low air humidity of, say, 0.004 humidity ratio, and the humidity ratio achievable is limited by the concentration of the desiccant (and therefore the relative humidity of the air in contact with it) flowing from the regenerator. The opposite process takes place in the regenerator, or in an apparatus used for heating and humidifying the air in winter. The operation of the regenerator will be examined below, and it will be shown that the maximum concentration of the desiccant is limited by the temperature of the heating fluid.

Some of the previously proposed air conditioners mentioned above use heat transfer partitions or other heat exchangers that do not allow the creation of full turbulent flow (a Reynolds number of at least 300 and preferably 500 or more) and thus limit the rate of heat transfer between the fluids. When heat exchangers are used in the present apparatus and methods, pumping the fluids at the designed rate to cause turbulent flow gives a high heat transfer coefficient and thus minimizes the size and cost of the heat exchangers.

The method proposed can generally use components that are relatively easy to obtain at a reasonable cost rather than requiring highly specialized components that would make the cost of the apparatus high.

The significance of the claims that involve performance of the apparatus using the proposed method is that other methods do not achieve such low humidity conditions in the cooled supply air while using a relatively high temperature cooling source. For example, it is believed to be possible to operate embodiments of the present apparatus with a cooling liquid at 62 degrees F. (17° C.) in conditions where a cooling fluid at 50 degrees F. (110° C.) or below would be required in a conventional air conditioner, e.g. 43 degrees F. (6° C.) is typical in a chiller system. Similarly, the significance of the claims concerning the performance of the regenerator is that other methods do not achieve such a concentrated desiccant solution while using a relatively low-temperature heating source. The method of achieving these high performances can be demonstrated by reference to the psychrometric chart FIG. 1.

The method proposed enables the supply to the conditioned space of an airstream that has a relative humidity close to the equilibrium level of the air in contact with the concentrated liquid desiccant while using a cooling fluid that is fairly close in temperature to the supply air (for example 9 degrees F. (5° C.) cooler).

The method also enables the reconcentration of the liquid desiccant by an airstream that is heated minimally above ambient temperature (foe example, 30 degrees F. (17° C.) warmer) compared with most other methods that require either a large and expensive apparatus or high temperatures to achieve the same results.

In an embodiment, a simple control device is provided to control the concentration of the desiccant.

The method proposed also allows the humidification of the supply air in winter mode by diluting the desiccant. Diluting the desiccant increases its volume and thus would require the provision of surplus volume in one or more of the desiccant sumps. However, in many embodiments it is not desirable to have large sumps or volumes of desiccant in the apparatus and so a separate inexpensive reservoir may be provided. This serves three purposes: 1. Ability to accommodate changing desiccant volumes; 2. Separation of concentrated and dilute desiccant within a single or multiple containers; 3. Storage of desiccant so that the air conditioner may be operated for a period of time when the heating sources are not available (so long as auxiliary power to operate pumps and fans is still available).

In an embodiment, the appropriate increase in concentration of the desiccant, when required or desired, may be carried out by a regenerator that is configured similarly to the air conditioner but used to evaporate water from the desiccant. The regenerator uses an airflow to reconcentrate the desiccant where the air is preferably taken from the conditioned space or another source that is drier than outside air. Since building exhaust air is typically lower in volume than the supply air because of losses due to leakage and extract fans in bathrooms, for example, from which the air cannot be economically collected, the regenerator may be designed so that it may use a lower flow than the airflow of the air conditioner by applying greater healing to remove the required mass of moisture from the desiccant. The building exhaust air is first heated in the regenerator using a heating fluid (such as the exhaust air) passed through a heat exchanger to recover waste heat. The air is then heated at each stage by contact with the desiccant heated in the heat exchanger at each stage, thus lowering the relative humidity of the exhaust air, and enabling it to evaporate water from the desiccant in a step-wise manner wait progressively lower relative humidity air at each step. The maximum concentration of she desiccant obtained is directly related to the minimum relative humidity of the air and the equilibrium relative humidity of the desiccant should be within 2 to 5% of the relative humidity of the air and in a preferred embodiment be within 2% of the relative humidity of the air. Once reconentrated, the liquid desiccant is reused in the air conditioner to remove humidity from outside air. In winter some of the energy and moisture in the air leaving the building is recovered in the regenerator using the desiccant to absorb heat and humidity that is then reused in the air conditioner to add to the incoming air.

In an embodiment, the air conditioner and the regenerator are modular in construction and the modules in the air conditioner and the regenerator may be identical, or similar but with altered dimensions to suit the air flow in each device. The number of modules comprising the sectors and the contained desiccant pads may be varied to suit the climate and operating requirements for which the whole apparatus is built. Having more modules in the air conditioner enables the relative humidity of the air to more closely match the relative humidity of the desiccant supplied to the air conditioner. Having more modules in the regenerator enables the relative humidity obtained by the liquid desiccant to approach more closely the minimum relative humidity of the air used for regeneration.

An embodiment of a complete air conditioner comprises a system including: an air conditioner; a desiccant regenerator; optionally, a desiccant storage device with spare capacity to accommodate the volume of water added to the system when operated in humidification mode; and when the system is in use sufficient liquid desiccant to fill the system to the required levels.

External to the apparatus, that embodiment of a system also includes: a source of coding fluid to remove sensible and latent energy from the system in the cooling season; a source of heating fluid to heat and humidify the outside air in the heating season; a source of heating fluid to evaporate moisture from the desiccant; a supply of electricity or other motive power to drive the pumps and fans and operate the controls; and a source of water treated to remove most of the salts to provide humidification when required.

In an embodiment, there is provided a method of cooling and dehumidifying an outside airstream that comprises: contacting the air stream with a liquid desiccant absorber in each of at least two stages; cooling the desiccant for each said stage externally to the absorber using an external source of cooling supplied with a common cooling fluid at each stage; causing the desiccant to flow between the stages counter-current to the flow of the airstream such that at each step the humidity of the air is reduced by contact with the desiccant and the concentration in each stage is distinctly higher than the concentration of the desiccant in the previous stages.

In an embodiment, there is provided a method of heating and humidifying an outside airstream that comprises: contacting the airstream in at least two distinct stages of contract with dilute liquid desiccant evaporators; during each of said stages, heating the desiccant externally to the evaporator using a common external source of heating at each stage; causing the desiccant to flow between the stages counter-current to the flow of the airstream such that at each step the humidity of the air is increased by contact with the dilate desiccant.

In an embodiment, there is provided a method of reconcentrating a liquid desiccant that comprises: contacting an airstream with liquid desiccant evaporators in each of at least two stages; heating the desiccant at each said stage externally to the absorber using an external source of heating supplied with a common heating fluid at each stage; and causing the desiccant to flow between the stages counter-current to the airstream, such that at each stage the concentration of the desiccant is distinctly higher than the concentration of use desiccant in the other stages.

In an embodiment, there is provided an apparatus for exchange of heat and moisture between an airstream forced through the apparatus, an external fluid source, and a liquid desiccant flow that comprises: at least two separate but connected modules that are essentially identical, each module comprising: an absorber/evaporator for contacting liquid desiccant with air, a liquid desiccant distributor for distributing liquid desiccant over the absorber/evaporator, a heat exchanger external to the absorber/evaporator to cool/heat the liquid desiccant with fluid from the external energy fluid source, a pump operative to recirculate the liquid desiccant between the absorber/evaporator and the heat exchanger; an outer shell to direct the airstream through the absorber/evaporator; and a sump below the absorber/evaporator to collect the liquid desiccant distributed over the absorber/evaporator.

BRIEF DESCRIPTION OF THE DRAWINGS

The above and other aspects, features, and advantages of the disclosed embodiments may be more apparent from the following more particular description of embodiments thereof, presented in conjunction with the following drawings. In the drawings.

DETAILED DESCRIPTION OF THE ILLUSTRATED EMBODIMENTS

A better understanding of various features and advantages of the present methods and devices may be obtained by reference to the following detailed description of illustrative embodiments and accompanying drawings. Although these drawings depict embodiments of the contemplated methods and devices, they should not be construed as foreclosing alternative or equivalent embodiments apparent to those of ordinary skill in the subject art.

Figure 2:
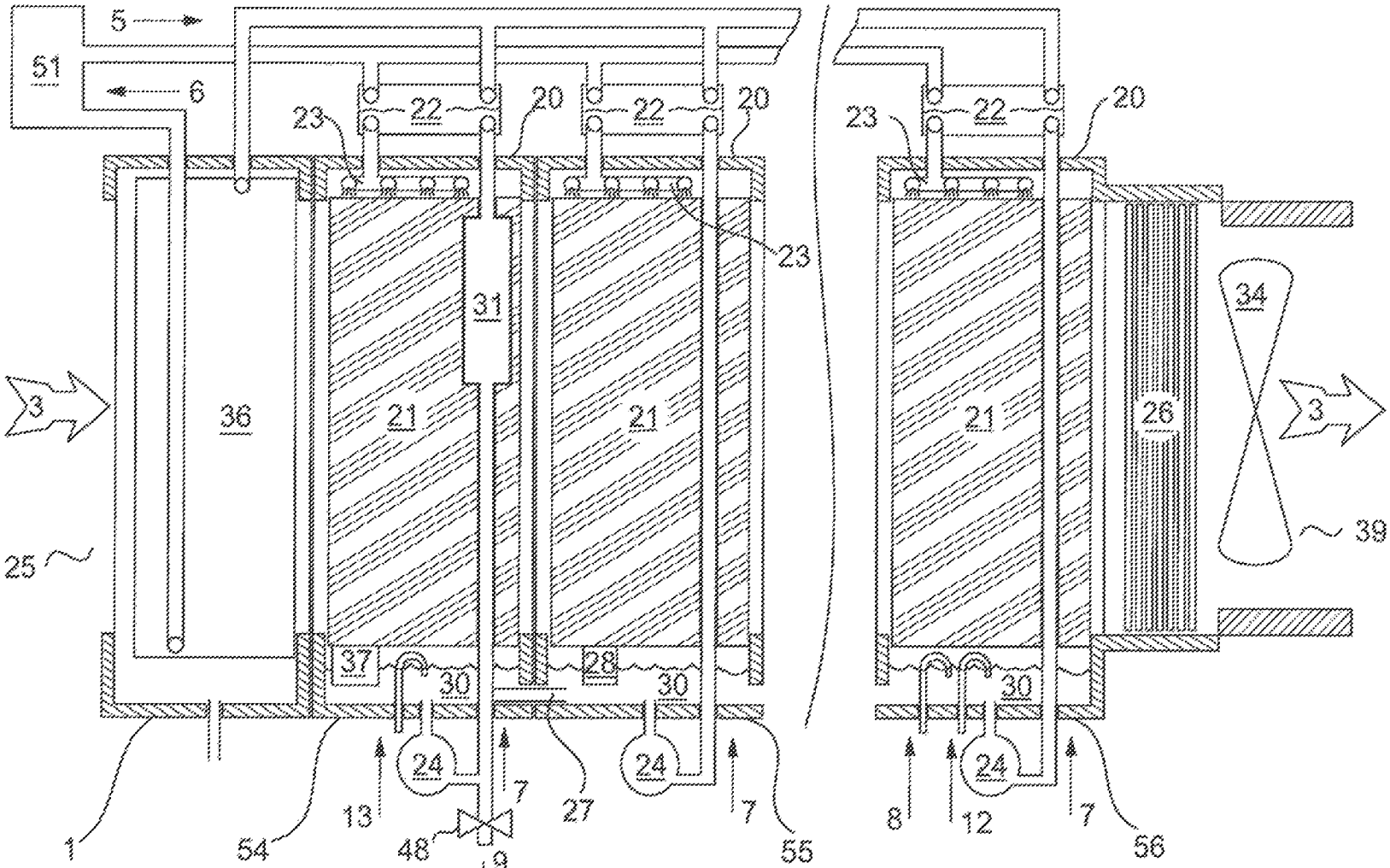
FIG. 2 is a diagrammatic side elevation view of an air conditioning device.
Figure 3:
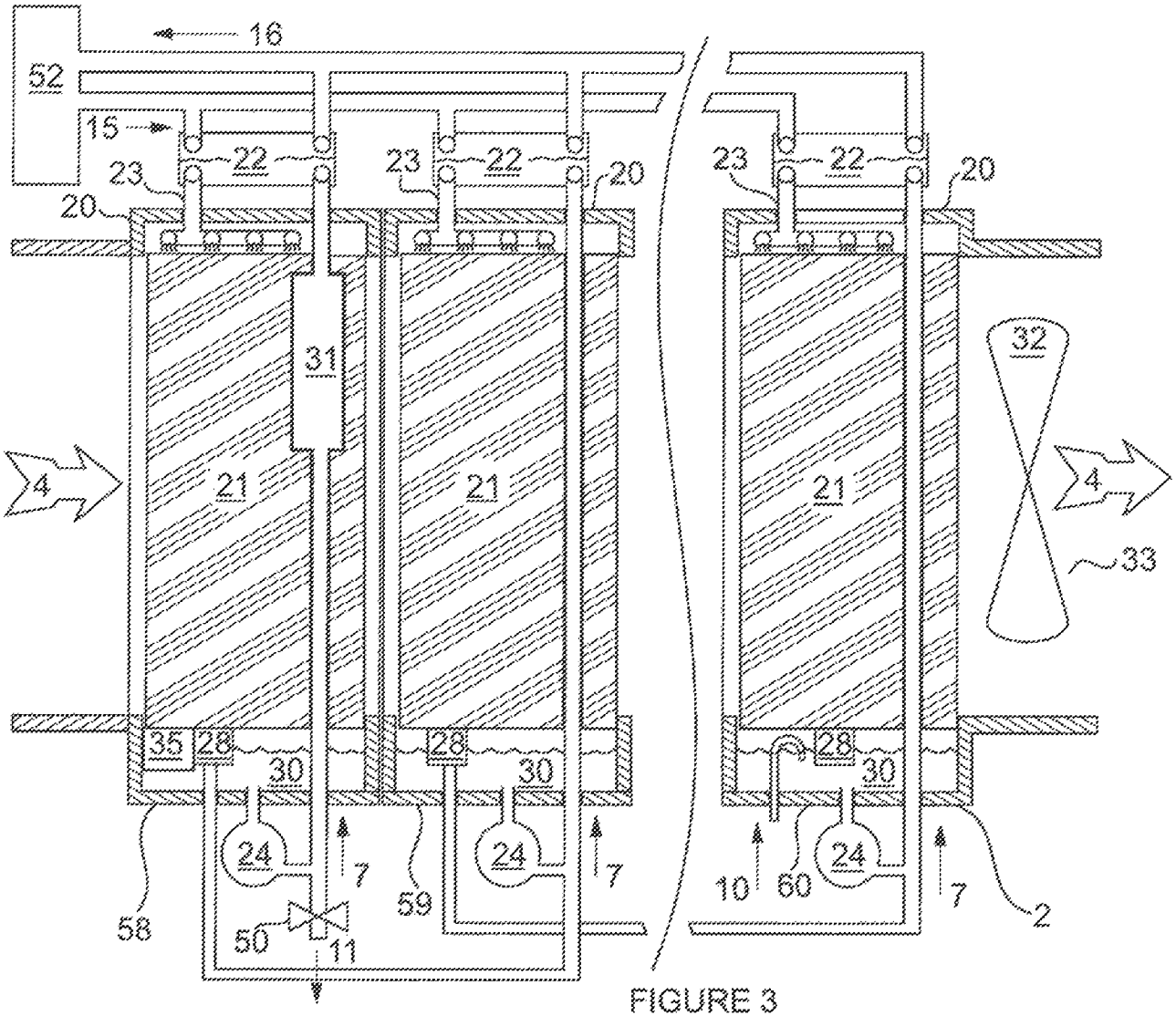
FIG. 3 is a diagrammatic side elevation view of a desiccant regenerating device.

Referring to the drawings, and initially to FIGS. 2 and 3, a first device, indicated generally by the reference numeral 1, and referred to as "Device 1," is used to condition the incoming airstream 3. In summer, Device 1 can be used to cool and dehumidify the incoming airstream. In winter, Device 1 can be used to warm and humidify the incoming airstream. A second device, indicated generally by the reference numeral 2, and referred to as "Device 2," is used to concentrate the liquid desiccant using airstream 4. The structure of each device is modular where one module, 54, 55, 56, 58, 59, or 60, comprises an air enclosure 20 with media pad 21, desiccant distributor 23 and desiccant basin or sump 30 that together make up one sector, plus a heat exchanger 22 and a pump 24 that complete the module. Devices 1 and 2 are shown in FIGS. 2 and 3 with three modules drawn in detail. Device 1 comprises a first module 54, an intermediate module 55, and a last module 56, in order of the direction of air flow. Device 2 comprises a first module 58, an intermediate module 59, and a last module 60, in order of the direction of air flow. Either device, independently of the other, may have no intermediate module 55, 59, or more than one intermediate module, so there may be only two or there may be more than three modules in total in each of Device 1 and Device 2. Desiccant flow between modules may be effected by tubes 27 shown in FIG. 2. The tubes 27 provide throttled flow between the sumps 30 of adjacent modules. Alternatively to tubes 27, desiccant flow between the modules may be achieved by other means such as a side-flow from the desiccant pump 24 to the next sector as shown in FIG. 3 where the level of desiccant in each sector is controlled by a device 28 that may be similar to a toilet float valve provided that the materials used in its manufacture are resistant to the desiccant such as most plastics.

Figure 4:
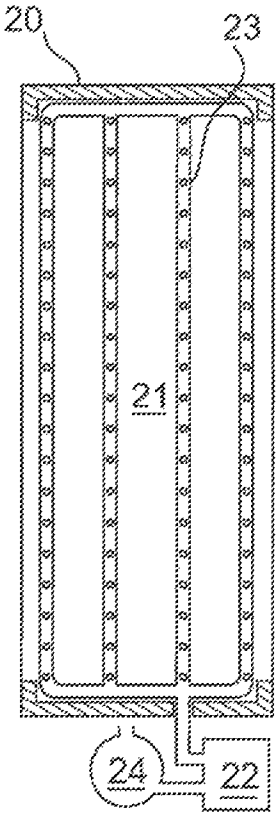
FIG. 4 is a plan view of one sector of a device of FIG. 2 or FIG. 3.
Figure 6:
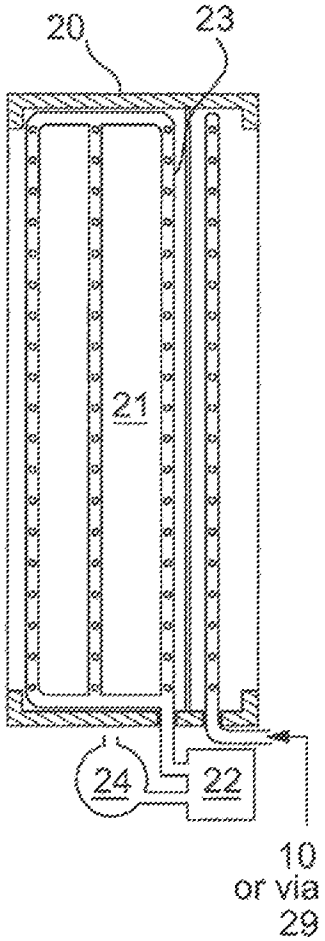
FIGS. 5 and 6 are views similar to FIGS. 3 and 4 of an alternative embodiment.
Figure 5:
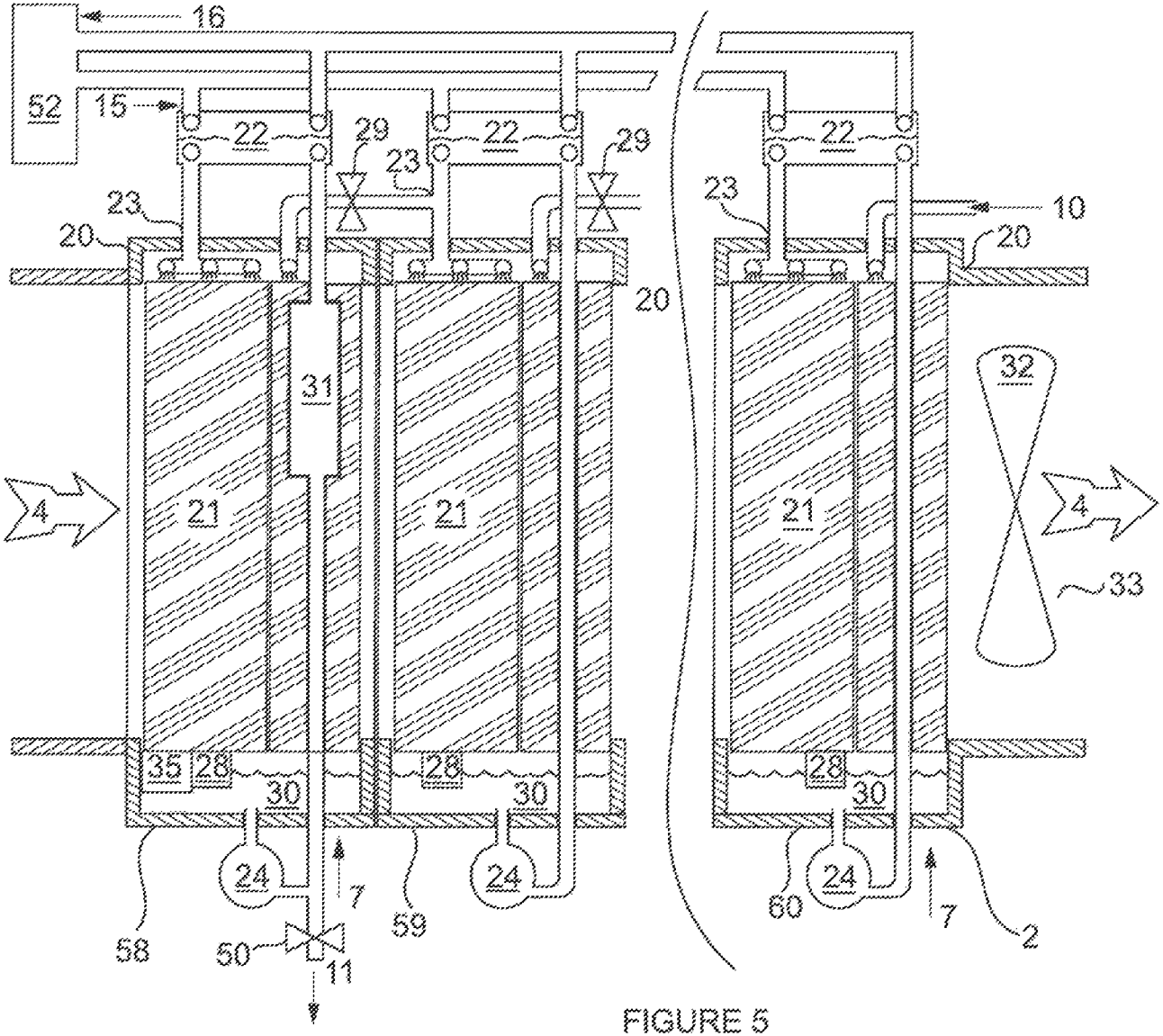

Referring now to FIGS. 5 and 6, a further embodiment of the apparatus is the same as that shown in FIGS. 3 and 4 except as described below. The same reference numerals are used for components that are the same, and in the interests of conciseness the description of those components is not repeated. In the apparatus shown in FIGS. 5 and 6, the side-flow that is fed to the next sector is taken at the outlet from the heat exchanger 22 and delivered so the trailing side of the upstream pad 21 via a separate tube shown in FIG. 5. The float 28 in each sector senses the level of liquid in the sump 30 as previously described, and operates a valve 29 that controls flow entering that sector in the separate tube. The nozzles in desiccant distributor 23 that distribute onto the pad 21 the desiccant from the pump 24 in the same sector may be arranged not to extend to the trailing side of the pad 21 where the side-flow from the adjacent sector is supplied.

Thus, in the air conditioner (Device 1) the more concentrated desiccant is used to dehumidify the air before it is mixed with the less concentrated desiccant in the adjacent sector. A further improvement in performance may be obtained by separating the pad 21 into two parts, a main part and the trailing side, to avoid any dilution before the stronger desiccant reaches the sump 30, as shown by the dividing lines in FIG. 5 and FIG. 6 on pad 21.

Figure 7:
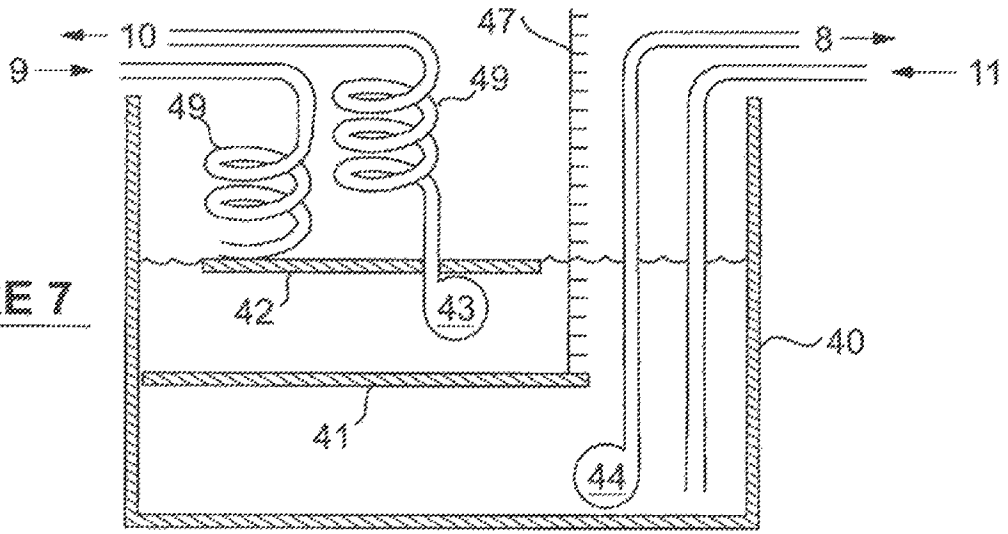
FIG. 7 is a diagrammatic side elevation view of a desiccant reservoir.

FIG. 7 shows a single container reservoir that comprises container 40. A mid-density float 41 reduces stirring and serves to separate the more dilute from the more concentrated desiccant. A float 42 on the surface of the liquid body allows the dilute desiccant 9 to be delivered to the reservoir at the top of the liquid body and allows the dilute desiccant 10 to be withdrawn from the reservoir by pump 43 at the top of the liquid body. Flexible tubes 49 allow the float 42 to rise and fall without restriction. A tube delivers concentrated desiccant 11 to the bottom of the reservoir. A pump 44 withdraws concentrated desiccant from the bottom of the container flow 8. An optional calibrated wand 47 attached to mid-density float 41 indicates the amount of concentrated desiccant in the container.

Figure 8:
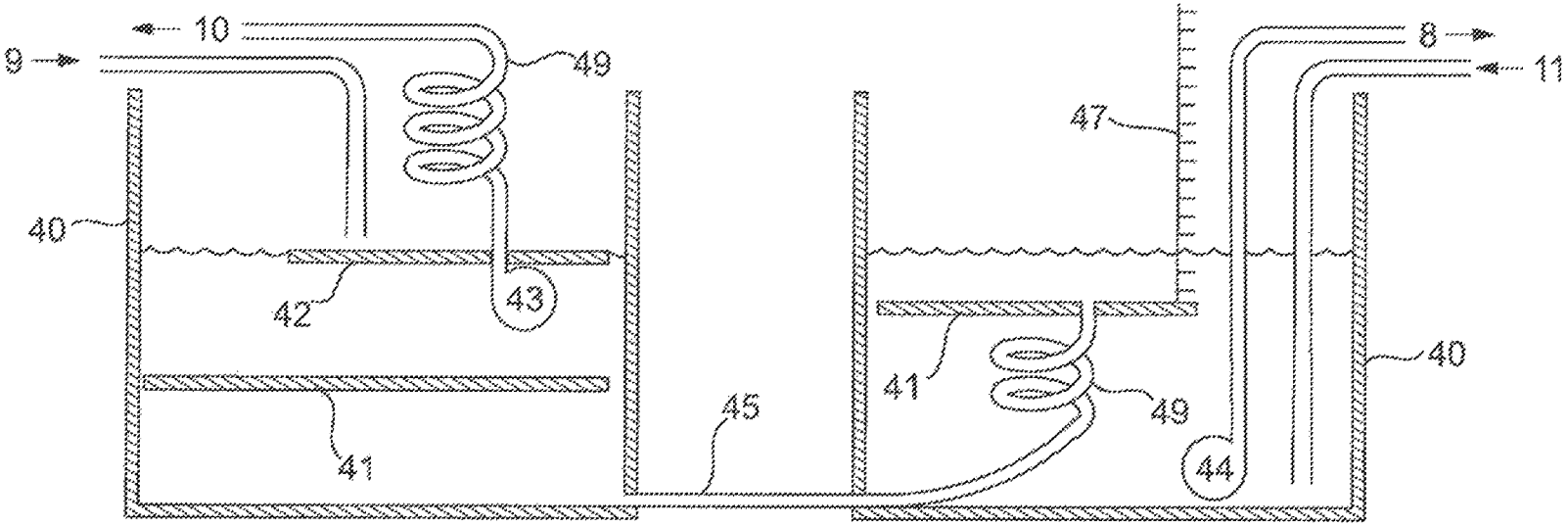
FIG. 8 is a diagrammatic side elevation view of an alternative desiccant reservoir.

FIG. 8 shows a two container reservoir that more completely separates the dilute desiccant in one container from the concentrated desiccant in the other and comprises similar components as shown in FIG. 7 and in addition a tube 45 that connects the dilute desiccant container with the concentrated desiccant container. Tube 45 is connected to the bottom of the dilute desiccant container, and is attached to a mid-density float 41 in the concentrated desiccant container by a flexible tube 49, and opens out through the top of mid-density float 41 as shown, so that dilute desiccant is able to flow to the concentrated desiccant container if needed but only above the float 41. Conversely only desiccant more dilate than a threshold set by the density of float 41 can flow back to the dilute desiccant container, because float 41 will rise to the top of the liquid in the concentrated desiccant container when all the desiccant in that container is concentrated.

Thus, either a single reservoir or two reservoirs or other similar embodiments may be used to receive flow 9 or 11 from Device 1 or 2, respectively, and may return flow 8 or 10 to Device 1 or 2, respectively. In this way, either of Devices 1 and 2 may operate independently for a time provided there is sufficient concentrated or dilute desiccant available in the reservoir.

Figure 1:
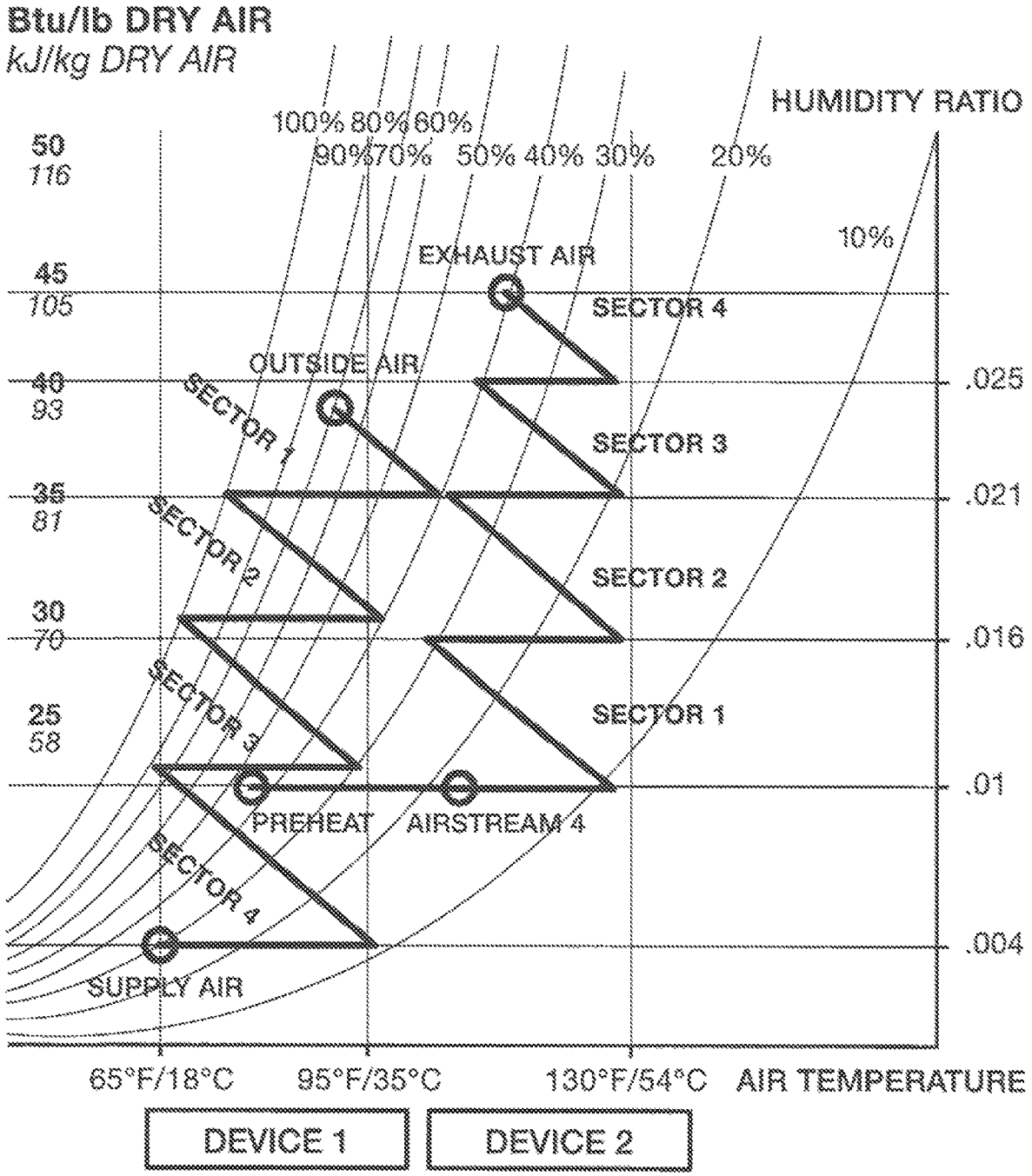
FIG. 1 is a psychrometric chart.

FIG. 1 shows on a psychrometric chart an example of the temperature and humidity chances that are caused to take place in the airstreams 3 and 4 in cooling season operating mode at high moisture removal for devices that each have four sectors. The adiabatic dehumidification and sensible cooling lines are illustrative of the overall aggregate process and are not intended to model the process in precise detail.

As shown in FIG. 2, in Device 1, an ambient air stream 3 is caused by a fan or other air movement device 34 to flow first through, an optional cooled coil 36 that partially removes moisture from airstream 3 by condensation, and then through a number of modules each comprising a sector of the apparatus that are connected together in an airtight fashion from the air inlet 25 to an outlet 39 that may optionally contain a demister 26. The sector nearest inlet 25 is here called Sector 1 and shown in FIG. 2 as within module 54. The air movement device may be situated at any convenient and effective position in the device or connected to it at either end and causes the air stream 3 to exit the device to the conditioned space. Each module of the device contains a media pad 21 that allows air to pass through without undue resistance (about 0.1 inches water gauge or 25 Pascals maximum per pad). Each pad is wetted evenly by a distribution device 23 with desiccant pumped to the pad 21 by a pump 24 from a basin 30 via a heat exchanger that either cools or heats the desiccant depending on the desired temperature of the supply airstream 3, i.e. whether the apparatus is in cooling or heating mode. In a preferred embodiment the flow 7 from pump 24 should be determined in conjunction with performance data for the heat exchangers 22 used in the device and the general guideline in the next paragraph.

The ending fluid 5 is supplied to the Device 1 from an external source 51 and may be returned to that source via flow 6 for re-cooling or used for some other purpose. The cooling fluid to optional coil 36 may be from the same source and may flow either in parallel or serially following the flows to the heat exchangers. In the preferred embodiment the heat exchanger 22 is a plate heat exchanger made of a material resistant to the desiccant but other devices than a plate heat exchanger may be used to cool the desiccant. For example, a geo-exchange loop or other forms of heat exchanger such as used for refrigerants or absorbing fluids when the apparatus is used in conjunction with a heat pump as the cooling source 31. Typical sources of cooling for fluids 5 going to the heat exchangers may be for example, a geo-exchange loop, a return cold-water stream from a chiller, or cold refrigerant from a compressor, so long as the source fluid is, say, 9° degrees F. (5° C.) cooler than the desired supply airflow 3 to the conditioned space.

A flow of desiccant through Device 1 is caused by the removal of a flow 9 that is part of the output of pump 24 in Sector 1. The flow 9 of desiccant causes a fall in the level of desiccant in Device 1. When the level in Device 1 falls to a pre-set level, a float switch, or switches, 28 activates a flow of desiccant 8 into Device 1 into the sector furthest from Sector 1 shown in FIG. 2 as module 56. The concentrated desiccant 8 may optionally be delivered to the trailing side of the pad in module 56 as has been described above in describing FIGS. 5 and 6. Desiccant then flows through the device to each of the sectors as described above via tubes 27 or by a partial flow from each pump 24 controlled by a level controller 28 in the adjacent sector or other alternatives described above. The rate of flow 9 out of the first sector, module 54, is determined by a mechanism 37 and valve 48 that measure and control the desiccant concentration and increase or decrease the flow so that the dilution of the desiccant is suitable for the regenerator, Device 2. Alternatively to using a mechanism 37, the desired flow through valve 48 may be calculated from the change in humidity of the airflow 3 through Device 1.

In the preferred embodiment of Device 2, an air stream 4 is caused by a fan or other air movement device 32 to flow through a number of modular sectors that are connected together in an airtight fashion from the air inlet 29 to an outlet 33 as airstream 4 where it is discharged to atmosphere away from the inlet of airstream 3. The air movement device may be situated at any convenient and effective position in the device or connected to it at either end in such a way as to cause the air stream 4 to flow through the device. In most applications, the air stream 4 will be taken from the building exhaust air because this is the air with the lowest humidity ratio available and will thus better concentrate the desiccant. The airstream 4 may be optionally pre-heated using the sensible heat from airstream 4 leaving Device 2 by means of heat recovery coils or an air-to-air plate heat exchanger (not shown here and which are standard HVAC practices).

Device 2 is essentially the same as Device 1 if the optional items 26 and 36 are omitted. The operation of the sectors in Device 2 is essentially the same as Device 1 except that in Device 1 the action of the liquid desiccant on the air is generally to cool and dehumidify and in Device 2 it is to heat and humidify the air thus reconcentrating the liquid desiccant.

In Devices 1 and 2 the pump 24 causes a flow of the liquid desiccant 7 over the media pad at a rate of, say, 1.5 to 2 gallons per minute per square foot (60-80 liters per minute per square meter) of horizontal surface area. This is a satisfactory flow rate for a horizontal airstreams 3 and 4 rate of around 6 feet (2 meters) per second. If higher airstream rates are desired but still less than 10 feet (3 meters) per second, then the liquid flow rate 7 may have to be reduced to prevent the formation of droplets of desiccant that could carry over into the airstream. For best performance the airstream velocities should be as uniform as possible across the face of the pads to prevent localized carryover. The distribution of desiccant onto the top of the media pad 21 should be uniform, and this may be effected by a distributor 23 consisting of an array of tubes with holes at intervals such that there are 20 to 30 holes per square foot (200-300 per square meter) evenly spaced across the media pad horizontal surface. Such a device 23 is shown in FIG. 4 for a single sector, but other means of distributing the liquid desiccant evenly onto the pad 23 may be used.

The material of the media pads 21 in either device 1 or 2 is such that it is resistant to the desiccant and that the pads remain un-deformed at the temperatures that may be used. Such media may be evaporative cooler media, for example, those sold under the Trade Mark: CELDEK by Munters AB of Kista, Sweden, and higher temperature versions of such media, for example, those sold under the Trade Mark GLASDEK by Munters AB, and as used in chemical towers, such as those sold by Lantec Products Incorporated, of Agoura Hills, Calif., where needed.

The heat exchangers in Device 2 receive flows of healed fluid 15, shown in FIG. 3, that heat the liquid desiccant in each sector in a similar manner to that described for Device 1 and flow 5. The heating fluid may return to the external heating source 52 via flow 16 for reheating or some other purpose.

The outer surface of the sector enclosure 20 and heat exchangers 22 should be insulated, as is good practice with most HVAC devices, to reduce the loss of heat to atmosphere. The insulation may be conventional and, in the interests of conciseness and clarity, is not further illustrated or described.

The liquid desiccant may be a concentrated solution in water of either Lithium Bromide or Lithium Chloride or a mixture of the two or another liquid desiccant capable of producing a low relative humidity when in contact with an airstream. The use of Lithium Bromide enables a lower relative humidity to be achieved in the airstream 3 than does Lithium Chloride although either can produce when in equilibrium a relative humidity in the air of 12%. The liquid desiccant must be suitable to remove the moisture from the airstream 3 to the level required for the particular application. Other liquid desiccants are possible such as Calcium Chloride but some others have disadvantages of toxicity and/or insufficient temperature and humidity range. The solutions of Lithium salts chosen as preferred desiccants do not freeze in the normal concentration/temperature range and have beneficial biocidal action on all tested bacteria and viruses including the Severe Acute Respiratory Syndrome (SARS) virus. Device 1 also serves as an air-cleaning device for fine particles, pollens and spores that can bypass a normal air filter. Material removed from the air is washed into the desiccant and collected by a cartridge filter 31 in the recirculating line (flow 7) from pump 24 to heat exchanger 22.

In the preferred embodiment of the whole apparatus, concentrated desiccant flow 11 from Device 2 flows to a reservoir as shown FIG. 7, from which it is pumped to Device 1 when required as flow 8. The desiccant flow 9 from Device 1 flows to a different part of the storage device and when required in Device 2 is pumped as flow 10. As described, in summer operation, Device 1 is acting as a dehumidifier, and Device 2 is acting as a regenerator, flow 9 from Device 1 is dilute desiccant solution, and is delivered to the top of the reservoir. Flow 11 from Device 2 is concentrated desiccant solution, and is delivered to the bottom of the reservoir. Flow 8 to Device 1 is concentrated desiccant solution, and is taken from the bottom of the reservoir. Flow 10 to Device 2 is dilute desiccant solution, and is taken from the top of the reservoir. In winter, when Device 1 is acting as a humidifier, there will be normally no flow 9 because all the water added as flow 12 will evaporate into airstream 3 and thence pass into the conditioned space as desired. Device 2 may in winter be used as an enthalpy recovery device in which case flow 11 is switched to go directly to Device 1 as flow 13 and flow 9 goes directly to Device 2 as flow 10. The switching is achieved by standard procedures using plumbing T-valves activated when the mode of operation is changed, and is not shown here.

The more concentrated desiccant is kept separate from the dilute desiccant in the desiccant reservoir. However, in alternative embodiments the desiccant reservoir may be omitted and the desiccant flow 9 may go directly to Device 2 as flow 10 and desiccant flow 11 may go directly to Device 1 as flow 8 provided that minimum and maximum working levels of desiccant are maintained in the sumps 30 of each sector of each device as required to maintain the flow of desiccant through the heat exchangers 22 and over the pads 21 in each sector.

Increasing or decreasing the flow 11 controls the desiccant concentration from Device 2 via sensor 35 or by calculation from the difference in the humidity of airflow 4 entering and leaving Device 2. In one embodiment of such a sensor 35, part of the concentrated desiccant in Sector 1 of Device 2 flows from the pad 21 into a small basin that overflows into the sump 30. Thus, the desiccant in the sensor basin is a sample of the most concentrated desiccant being produced by Device 2. Sensor 35 contains a mechanism such as a float connected to a pressure sensitive device calibrated to read the specific gravity and therefore the concentration of the desiccant. Valve 50 operates with sensor 35 or by calculation to maintain the concentration of the desiccant at a level consistent with the relative humidity required in airstream 3 and the temperature of heating source 15.

In Device 1, a similar sensor 37 or calculation method described is used with valve 48 to ensure that desiccant flow 9 has been sufficiently diluted since the flow of desiccant to the reservoir and to Device 2 should be dilute for proper and economic operation of the regenerator.

The apparatus functions as follows:

In cooling/dehumidification mode, which is defined as when the airstream 3 is required to be dehumidified by Device 1, heat source fluid 5 is cool and when the system is in operation, i.e. the pumps and air movement devices are functioning as described above, the airstream 3 is cooled and partially dehumidified by contact with the optional cold coil 36, then dehumidified and cooled by passage through the desiccant modules 54, 55 and 56 of Device 1 and flows to its required application of conditioning a space. The desiccant flow 8 will normally be required to be concentrated in order for the Device 1 to simultaneously cool and remove humidity from the air. This process progressively dilutes the desiccant in the sectors as described above and the dilute desiccant exits Device 1 via flow 9.

Device 2 receives diluted desiccant either front a reservoir or directly from Device 1 via flow 10 which flows into the sector of Device 2 nearest the airflow outlet 33 shown in FIG. 3 as part of module 60. The desiccant flows by gravity through a connecting tube 27, or by a partial flow from pump 24 in the adjacent sector as described for Device 1. When the desiccant reaches Sector 1 (shown as module 58) a partial flow 11 of the concentrated desiccant is pumped by pump 24 either to a storage device or directly to Device 1 and is controlled by sensor 35 or by calculation, and by valve 50.

The change of temperature and humidity in the air in each of the sectors of each Device is shown on the psychrometric chart in FIG. 1 for an example where each device comprises 4 sectors. In Sector 1 of Device 1, outside airstream 3 undergoes a combination of two processes—adiabatic dehumidification and cooling—by the cooled desiccant. Two lines for each sector (adiabatic dehumidification, represented by a diagonal line at constant enthalpy, and cooling, represented by a horizontal line at constant humidity) in FIG. 1 show these two processes separately although they take place more or less simultaneously as the desiccant is pumped by pump 24 at a rate several times the rate at which the desiccant flows to the next sector.

The amount of dehumidification and cooling of the airstream is limited by vapor pressure of the desiccant (which is a function of its concentration) in that sector and the amount of heat transferred to the desiccant via the heat exchanger 22 in that module. The desiccant that the air is in contact with in Sector 1 has already passed through the other sectors and so is relatively dilute but the rate of flow of desiccant between the sectors is such that the desiccant is sufficiently concentrated to remove a fraction of the moisture in the airstream 3. The air enters Sector 2 and is treated in the same way by desiccant that enters Sector 2 more concentrated than that in Sector 1.

In FIG. 1, four sectors are shown treating outside air 3 from 95 degrees F. (35° C.) and 0.025 humidity ratio (HR=mass of moisture per mass of air) to a supply condition in airstream 3 of 65 degrees F. (18° C.) and 0.004 HR. The cooling fluid 5 in this example is at about 60 degrees F. (15.5° C.) and there is approximately a 5 degrees F. (3° C.) temperature differential across the heat exchangers. The incoming desiccant flow 8 should be sufficiently concentrated to produce the desired relative humidity of the supply airstream 3. When designing the apparatus it is necessary to ensure that the temperature of the cooling fluid 5 and the sizes of the heat exchangers 22 in Device 1 are sufficient to remove the maximum enthalpy from the outside airstream 3 to the conditions of the supply airstream required.

The reconcentration of the desiccant in Device 2 is also shown in FIG. 1 on the higher temperature portion of the psychrometric chart. The airstream 4 may be optionally preheated as described previously and then enters Sector 1 of Device 2 where it removes humidity in order to concentrate the desiccant that has been heated by exchangers 22. The horizontal lines for heating and the equal enthalpy line for adiabatic humidification represent this in FIG. 1 although both processes actually take place more or less simultaneously. The air then passes through Sector 2 of Device 2, shown in FIG. 3 as module 59, downstream in the direction of air flows, where it is further heated and the desiccant is concentrated by evaporation into the air.

In FIG. 1 four sectors are shown for each of Devices 1 and 2, with the air passing through them in numerical order (Sector 1, then Sector 2, then Sector 3, then Sector 4, corresponding to modules 54, 55, 55, 56 in FIG. 2 and 58, 59, 59, 60 in FIG. 3). The desiccant flows in the opposite direction to the air as already described. There may be two sectors or more depending on the operating conditions as described earlier. If more dilute desiccant is sufficient for the maximum dehumidification required then fewer sectors are required, whereas for a very concentrated desiccant more sectors will be required. The temperature of the heating fluid 15 that is used to heat the desiccant in a heat exchanger 22 in each sector also affects the number of sectors needed. A major advantage of the multiple-sector process described is the ability to use relatively low temperatures that are readily available from low-cost heat sources such as waste heat, solar-heated water and hot water available from chillers all of which are inexpensively available at around 130 to 140 degrees F. (54 to 60° C.).

Operation in winter mode, which is when the building controls the calling for heating of the incoming air, need not involve the use of Device 2 to alter the desiccant concentration although Device 2 may be used to recover heat and humidity from the building exhaust air. In winter the incoming air has low humidity and so humidification is desirable, which can be accomplished by a flow of water 12 into Device 1. This dilutes the desiccant in the last sector (in module 56) to the point where it humidifies airstream 3. Since water evaporates from the diluted desiccant under these circumstances, water flow 12 will operate as needed by level sensor 28 in module 56 to maintain the diluted desiccant level. The desiccant in Sector 1 of Device 1 will still remain sufficiently active as a biocide despite becoming partially diluted. A standard water treatment plant (not shown) is used where necessary to treat the flow of water 12 to remove impurities that could either affect the action of the desiccant or give rise to buildup of residue.

Heat and moisture recovery in winter mode using Device 2 may be accomplished by using Device 2 and Sector 1 of Device 1 as the two parts of an enthalpy run-around loop. Thus, Device 2 operates as in summer mode but without added heat from flow 15, which is shut off. The desiccant flow 10 enters as in summer mode and the desiccant picks up heat and moisture from the exhaust air from the building. The desiccant flow 11 exits Device 2 and valve 50 is fully open. The difference from summer mode operation is that flow 11 is routed to Sector 1 of Device 1 as flow 13, is pumped over the pad 21 and serves to pre-heat and pre-humidify the outdoor air flow 3.

Switching between summer and winter mode is achieved as above and by changing the flow into Device 1 from desiccant (flow 8) to water (flow 12), and the reverse switching involves changing back to desiccant and also reactivating Device 2. After activation of the winter mode and the desiccant has been diluted, flow 11 is switched to connect with flow 13 instead of going to the storage device.

In either Device 1 or 2, if gravity fed tubes 27 are used, the desiccant level may be controlled by turning the desiccant inflows 8 or 10 on or off according to a level sensor 28 that may be situated in a convenient location in one or more of the basins 30. Activation of the flows may be achieved either by turning on pump 43 or 44, or alternatively by opening a flow valve (not shown) in place of the pump if there is sufficient pressure to cause the flows 10 or 8.

In either device, if pumped desiccant flows are used between sectors the level control 28 is a float activated control valve that serves to directly control the inflow of desiccant except in the last sector where 28 controls a pump 43 or 44 in the reservoir.

It can be seen that one skilled in the art could construct and operate the apparatus described above to achieve cooling or heating and dehumidification or humidification of an air stream to provide controlled conditions in a building.

While the foregoing written description enables one of ordinary skill to make and use what is considered presently to be the best mode thereof those of ordinary skill will understand and appreciate the existence of variations, combinations, and equivalents of the specific embodiment, method, and examples herein. The invention is therefore not limited by the above described embodiments, methods, and examples, but extends to all embodiments and methods within the scope and spirit of the disclosure.

Accordingly, reference should be made to the appended claims, rather than to the foregoing specification, as indicating the scope of the invention. Aspects of the invention include combinations of the features of any two or more of the appended claims.

The invention claimed is:

1. An apparatus for exchange of heat and moisture between an airstream forced through the apparatus, an external energy fluid liquid source, and a liquid desiccant flow that comprises:

at least a first module to receive the airstream, wherein the first module comprises:

a first module absorber/evaporator for contacting liquid desiccant having a first concentration with air from the airstream, a first module liquid desiccant distributor for distributing liquid desiccant having the first concentration over the first module absorber/evaporator, a first module heat exchanger external to the first module absorber/evaporator to cool/heat the liquid desiccant with fluid consisting essentially of fluid from the external energy fluid source, a first module pump operative to recirculate the liquid desiccant between the first module absorber/evaporator and the first module heat exchanger to the first module liquid desiccant distributor;

a first module outer shell to direct the airstream through the first module absorber/evaporator; and a first module sump below the first module absorber/evaporator to collect the liquid desiccant having the first concentration distributed over the first module absorber/evaporator, the first module sump having a valve to discharge liquid desiccant from the first module sump to control the first concentration;

at least a last module to exhaust the airstream, wherein the last module comprises:

a last module absorber/evaporator for contacting liquid desiccant having a second concentration with air the air from the airstream where the second concentration is greater than the first concentration, a last module liquid desiccant distributor for distributing liquid desiccant having the second concentration over the last module absorber/evaporator, a last module heat exchanger external to the last module absorber/evaporator to cool/heat the liquid desiccant with fluid consisting essentially of fluid from the external energy fluid source, a last module pump operative to recirculate the liquid desiccant between the last module absorber/evaporator and the last module heat exchanger to the last module liquid desiccant distributor;

a last module outer shell to direct the airstream through the last module absorber/evaporator; and a last module sump below the last module absorber/evaporator to collect the liquid desiccant having the second concentration distributed over the last module absorber/evaporator wherein the last module sump receives liquid desiccant from a source to increase concentration of the liquid desiccant and wherein the last module sump is in fluid communication with the first module sump; and a source of fluid from the external energy fluid source in fluid communication with an intake of the first module heat exchanger and an intake of the last module heat exchanger wherein the intake of the first module heat exchanger and the intake of the last module heat exchanger are in parallel such that a temperature of the fluid from the external energy fluid source is approximately the same at the intake of the first module heat exchanger and the intake of the last module heat exchanger.

2. The apparatus of claim 1, further comprising a duct permitting liquid desiccant to flow between adjacent modules, wherein the first module pump is operable to remove liquid desiccant from the first module, and the last module pump is operable to supply liquid desiccant to the last module, and an impeller is operable to cause the airstream to flow in a direction from the first module to the last module.

3. The apparatus of claim 1, further comprising a second said apparatus, and wherein the liquid desiccant is operable to flow from the first module of the first said apparatus to a last module of the second apparatus, and from a first module of the second said apparatus to the last module of the first apparatus.

4. The apparatus of claim 1, where the modules are connected to provide an airtight flow and liquid tight desiccant flow through a number of modules such that the number of modules can be increased or decreased to accommodate different external design conditions and different external heating and cooling fluid temperatures.

5. The apparatus of claim 1, comprising a coil at an intake of the first module to remove moisture from an airstream prior to the airstream entering the first module.

6. The apparatus of claim 5 wherein the coil is in fluid communication with a discharge of both the first module heat exchanger and a last module heat exchanger.

7. The apparatus of claim 1, comprising a demister subsequent to an exhaust of the last module.

8. The apparatus of claim 7, comprising a coil at an intake of the first module to remove moisture from an airstream prior to the airstream entering the first module.

9. The apparatus of claim 5, comprising a demister.

10. The apparatus of claim 1, comprising a sensor in the first module sump to measure the concentration of desiccant such that the valve to discharge liquid desiccant from the first module sump to control the first concentration is opened or closed.

11. The apparatus of claim 10 wherein the sensor measures the specific gravity.

12. The apparatus of claim 1 wherein a float in at least one of the first module sump and the last module sump controls a level of desiccant in the first module sump and the last module sump.

13. The apparatus of claim 1 wherein a concentration of desiccant between the first concentration to the second concentration is counter current to an airflow.

14. An apparatus for exchange of heat and moisture between an airstream forced through the apparatus, an external energy fluid liquid source, and a liquid desiccant flow that comprises:

a coil at an intake of the apparatus, wherein the coil is to remove moisture from air from an airstream;

at least a first module coupled to the intake, wherein the first module comprises:

a first module absorber/evaporator for contacting liquid desiccant having a first concentration with the air from the airstream, a first module liquid desiccant distributor for distributing liquid desiccant having the first concentration over the first module absorber/evaporator, a first module heat exchanger external to the first module absorber/evaporator to cool/heat the liquid desiccant with fluid from the external energy fluid source, a first module pump operative to recirculate the liquid desiccant between the first module absorber/evaporator and the first module heat exchanger to the first module liquid desiccant distributor;

a first module outer shell to direct the airstream through the first module absorber/evaporator; and a first module sump below the first module absorber/evaporator to collect the liquid desiccant having the first concentration distributed over the first module absorber/evaporator;

at least a last module, wherein the last module comprises:

a last module absorber/evaporator for contacting liquid desiccant having a second concentration with the air from the airstream where the second concentration is greater than the first concentration, a last module liquid desiccant distributor for distributing liquid desiccant having the second concentration over the last module absorber/evaporator, a last module heat exchanger external to the last module absorber/evaporator to cool/heat the liquid desiccant with fluid from the external energy fluid source, a last module pump operative to recirculate the liquid desiccant between the last module absorber/evaporator and the last module heat exchanger to the last module liquid desiccant distributor;

a last module outer shell to direct the airstream through the last module absorber/evaporator; and a last module sump below the last module absorber/evaporator to collect the liquid desiccant having the second concentration distributed over the last module absorber/evaporator wherein the last module sump is in fluid communication with the first module sump; and the external energy fluid source of in fluid communication with an intake of the first module heat exchanger and an intake of the last module heat exchanger wherein the intake of the first module heat exchanger and the intake of the last module heat exchanger are in parallel such that a temperature of the fluid from the external energy fluid source is approximately the same at the intake of the first module heat exchanger and the intake of the last module heat exchanger.

15. The apparatus of claim 14 wherein the coil is in fluid communication with a discharge of both the first module heat exchanger and a last module heat exchanger.

16. The apparatus of claim 14, comprising a demister subsequent to an exhaust of the last module.

* * * * *